United States Patent [19]

Ruhaut et al.

[11] 4,304,548

[45] Dec. 8, 1981

[54] SESAME FROZEN LOCK OPENER

[76] Inventors: Robert C. Ruhaut, 64 Demott Ave., Clifton, N.J. 07011; Sol Milroad, 91 Locust Ave., Millburn, N.J. 07041

[21] Appl. No.: 100,252

[22] Filed: Dec. 4, 1979

[51] Int. Cl.[3] ..... F23Q 25/00

[52] U.S. Cl. ..... 431/151; 431/253; 70/431

[58] Field of Search ..... 126/401; 431/253, 156, 431/151, 152; 70/431

[56] References Cited

U.S. PATENT DOCUMENTS

| | | | |
|---|---|---|---|
| 3,023,748 | 3/1962 | Bruskin | 431/151 |
| 3,450,859 | 6/1969 | Brucker | 431/275 |

FOREIGN PATENT DOCUMENTS

| | | | |
|---|---|---|---|
| 2135935 | 1/1973 | Fed. Rep. of Germany | 431/253 |
| 2706137 | 8/1978 | Fed. Rep. of Germany | 70/431 |

*Primary Examiner*—Carroll B. Dority, Jr.
*Attorney, Agent, or Firm*—Mawhinney & Mawhinney & Connors

[57] ABSTRACT

The present invention is directed to a device for opening frozen locks on a motor vehicle, padlock or any locking mechanism which is subject to the elements. The device according to the present invention includes a key mounted on the closure lid of a cigarette lighter. In the inoperative position, the key is disposed against the front surface of the cigarette lighter, thereby forming a compact unit. In the operative position, the key is disposed directly above the flame of the cigarette lighter so as to maximize the heat of the flame in warming the key. In this manner, the key attached to the cigarette lighter, according to the present invention, is heated to a substantial extent, thereby readily enabling a frozen lock to be opened.

5 Claims, 7 Drawing Figures

FIG. 1
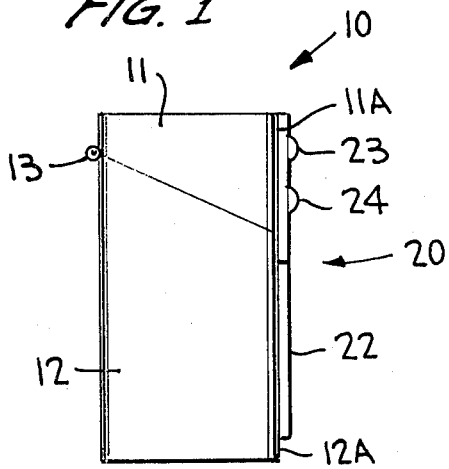
FIG. 2
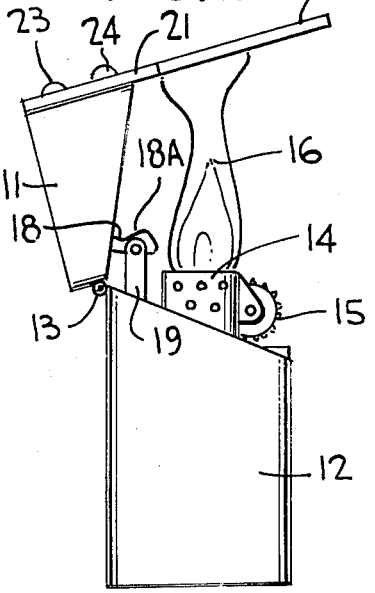
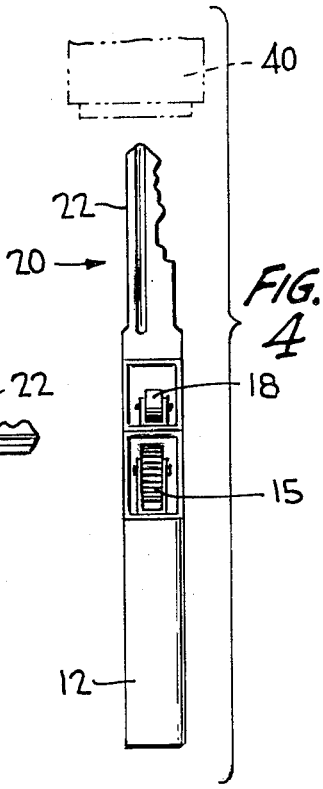
FIG. 4
FIG. 3
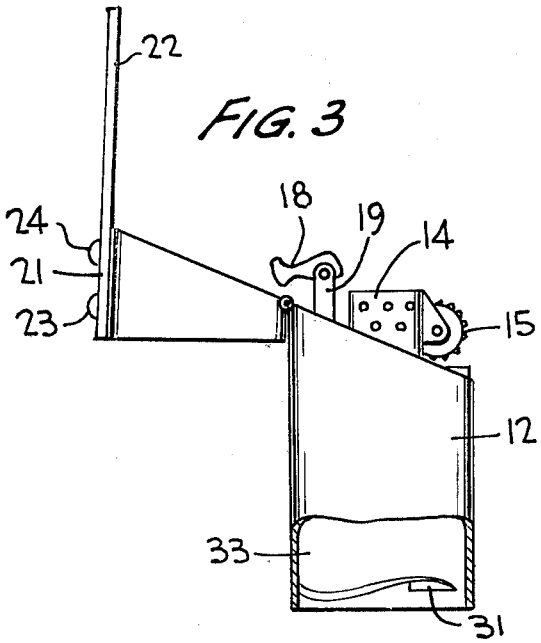
FIG. 5
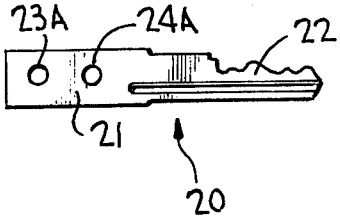
FIG. 6
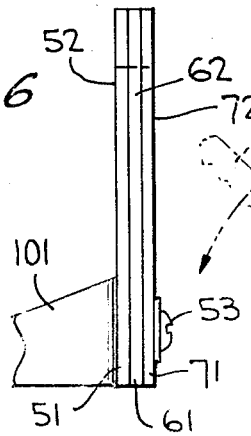
FIG. 7
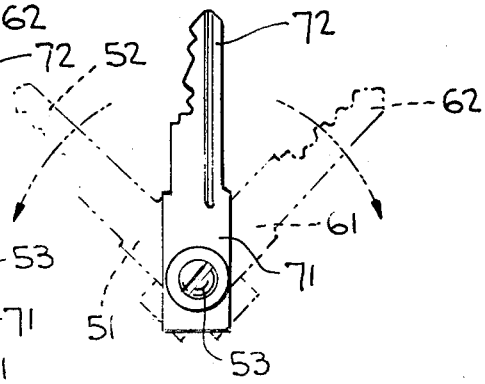

SESAME FROZEN LOCK OPENER

BACKGROUND OF THE INVENTION

1. Field of the Invention

The present invention is directed to the combination of a key and a cigarette lighter whereby a substantial heat may be imparted directly to the key thus permitting the key to readily open a frozen lock.

2. Description of the Prior Art

Many devices are available in the prior art for warming a key. However, all of these devices suffer from disadvantages which are overcome by the device according to the present invention.

Brucker, U.S. Pat. No. 3,450,859, discloses a device for heating a key for defrosting a frozen lock. The device is designed for a single purpose. A key 12 is positioned on a carriage 5 so that upon reciprocation of the carriage outwardly from an inoperative position to an operative position, the flint wheel 17 is caused to rotate thereby causing sparking of a flint 48 which ignites the burner 24. The burner 24 is specifically designed to heat the base portion of a key. This device is rather complicated and does not impart the greatest heat to the portion of the key inserted into a lock. As illustrated in FIG. 2 of Brucker, the flame 16 is disposed adjacent to the base of the key. Therefore, the extended portion of the key which is inserted directly into a lock is warmed only by convection from the heat applied to the base portion.

Bruskin, U.S. Pat. No. 3,023,748, discloses a lock deicer wherein a rather bulky chimney 30 is adapted to be positioned on top of a lighter. Disposed adjacent to the upper portion of the chimney 30 is a clip adapted to hold a key. Again, the flame is not applied directly to the extended portion of the key which is inserted into a lock. The device disclosed by Bruskin is similar to the device disclosed by Brucker since the extended portion of the key would be heated by convection from the base portion of the key. Neither of these devices maximize the heat applied to the extended portion of the key.

Allen, U.S. Pat. No. 2,585,071, discloses a combination cigarette lighter and accessory holder. In one embodiment of the Allen patent, a key may be positioned on a button 5 so as to reciprocate the key outwardly from a compartment 3. However, Allen does not disclose the heating of the key to permit opening of a frozen lock.

Cervera, U.S. Pat. No. 3,973,422, discloses a combination key and battery. A switch is provided for connecting the battery to the key to heat the base portion thereof. Again, the extended portion of the key is heated by convection from the warmth of the base portion of the key. Therefore, maximum heat would not be applied to the extended portion of the key which is inserted into the frozen lock.

OBJECTS AND SUMMARY OF THE INVENTION

It is a primary object of the present invention to provide a lighter device whereby maximum heat may be applied to the extended portion of a key which is inserted into a frozen lock.

Another object of the present invention is to provide a lighter device whereby, in the inoperative position, the key is disposed adjacent to the front surface of the lighter and forms a relatively compact unit.

A still further object of the present invention is to provide a lighter device whereby a key may be heated, if necessary, and whereby the flame of the lighter may be used to ignite a smoker's product or other material.

These and other objects of the present invention are accomplished by providing a key mounted directly to the closure lid of a cigarette lighter. In the inoperative position, the key is disposed adjacent to the front surface of the cigarette lighter and forms a relatively compact unit. In the operative position, the extended portion of the key is disposed directly adjacent to the flame of the cigarette lighter thereby imparting maximum heat thereto. In this manner, the extended portion of the key, which is inserted into a frozen lock, may readily open the frozen lock because of the maximum heat which has been applied thereto.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a side view illustrating the key and cigarette lighter, according to the present invention, in the inoperative position;

FIG. 2 is a side view illustrating the closure lid in an open position whereby the extended portion of the key is disposed directly above the flame of the cigarette lighter;

FIG. 3 is a side view illustrating a partial cut away of the bottom portion of the cigarette lighter;

FIG. 4 is a front view of the key and cigarette lighter as illustrated in FIG. 3 and further showing, in dotted lines, a frozen lock mechanism;

FIG. 5 is a plan view of a modified key blank suitable for use in the device according to the present invention;

FIG. 6 is a side view of a second embodiment of the present invention whereby a plurality of keys may be rotatably mounted on the closure lid of the cigarette lighter; and FIG. 7 is a front view of the embodiment according to the present invention as illustrated in FIG. 6 whereby the plurality of keys are rotated from their nested position.

DETAILED DESCRIPTION OF THE PRESENT INVENTION

As illustrated in FIGS. 1–3, the present invention is directed to a combination key and lighter 10. A modified key blank 20 is disposed on a front surface 11A of a closure lid 11. The modified key blank 20 is affixed to the front surface 11A by means of rivets or fastening screws 23, 24. The closure lid 11 is hinged at 13 to a base portion 12 of a cigarette lighter.

The modified key blank 20 includes a base portion 21 and an extended portion 22. The extended portion 22 includes the key teeth which are inserted into a locking mechanism as is conventional in the art. As illustrated in FIG. 1, in the inoperative position, the key 20 is disposed adjacent to a front surface 12A of the cigarette lighter 12. In this manner, a relatively compact cigarette lighter and key assembly is provided.

As illustrated in FIG. 2, in the operative position, the extended portion 22 of the modified key blank 20 is disposed directly above the flame 16 of the cigarette lighter. The cigarette lighter 12 includes a chimney 14 and a flint wheel 15 for igniting the flammable fluid disposed within a reservoir 33 of the cigarette lighter. As is conventional, by rotating the flint wheel 15, a spark is generated which ignites the flammable fluid which is supplied to the chimney portion 14 by means of a wick, not illustrated in the drawings. The flammable material disposed on the wick is ignited and a flame 16 is produced which extends upwardly from the chimney portion 14. The combination key and lighter assembly according to the present invention, positions the extended portion 22 of the modified key blank 20 directly above the flame 16. Therefore, maximum heat may be applied to the extended portion of the key 22 which is inserted into a frozen lock.

The closure lid 11 is retained in the closed position by means of a latch assembly 18. The latch assembly is pivotally mounted on a pin 18A which is affixed to a support member 19. In the open position, the latch assembly 18 is rotated about the pin 18A and permits the closure lid 11 to be raised from the closed position. However, in the closed position, the latch assembly 18 exerts a force against the closure lid 11 which biases the closure lid downwardly thereby retaining the lid in the closed position.

As illustrated in FIG. 3, the base portion 12 of the cigarette lighter includes a reservoir 33. Access to the reservoir 33 is available through a screw 31 which is exposed after an outer covering of the base portion 12 is removed. In another embodiment of the present invention, the access screw 31 may be disposed directly on the lower surface of the base portion 12 so as to be accessable without removing an outer covering.

As illustrated in FIG. 5, the modified key blank 20 includes an extruded portion 22 and a base portion 21. The base portion 21 includes openings 23A, 24A through which rivets or fastening screws may be inserted to affix the modified key blank 20 on the front surface 11A of the closure lid 11.

As illustrated in FIG. 4, the extended portion 22 of the modified kay blank 20 is designed for insertion into a lock mechanism 40. The combination key and lighter 10 according to the present invention imparts maximum heat to the extended portion 22. Therefore, the extremely hot extended portion 22 may readily be inserted into a frozen locking mechanism 40 and will readily permit the frozen lock to be opened.

A second embodiment of the present invention is illustrated in FIGS. 6 and 7. In this embodiment of the present invention a plurality of keys may be secured to a closure lid 101 of a cigarette lighter. The plurality of keys include an extended portion 52, 62, 72 and a base portion 51, 61, 71, respectively. The base portion 51, 61, 71 are affixed to the closure lid 101 by means of a screw or bolt 53. The plurality of keys are rotatably mounted about the screw or bolts 53, as illustrated in FIG. 7. The second embodiment of the present invention readily permits an individual to heat one of three keys for insertion into a particular frozen lock. However, the present invention is not limited to any particular number of keys which may be rotatably mounted to a closure lid.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for heating an extended portion of a key adapted for insertion into a lock comprising:

a lighter having a base portion for containing a flammable substance and an igniter means projecting upwardly from said base portion for supplying and igniting said flammable substance to produce a flame, said base portion including a front surface;

a closure lid means mounted on said base portion for selective movement between a closed position whereby said igniter means is covered and an open position whereby said igniter means is exposed, said closure lid means including a front surface in alignment with said front surface of said base portion;

at least one key including a base portion and an extended portion, said base portion being mounted on said front surface of said closure lid means and in alignment with said front surface of said base portion when the closure lid means is in the closed position; and said extended portion of said key being disposed directly above said flame produced by said ignition means to impart a substantial heat thereto when the closure lid means is in the open position.

2. A device according to claim 1, wherein said igniter means includes a wick in communication with said flammable substance, a chimney surrounding said wick and a flint wheel operatively disposed adjacent to said wick to ignite said flammable substance thereby producing a flame.

3. A device according to claim 1, wherein said closure lid means is hinged to said base portion.

4. A device according to claim 1, wherein a plurality of keys are rotatably mounted on said closure lid.

5. A device according to claim 1, and further including a latch assembly for releasably retaining said closure lid means in the closed position.

* * * * *